US009650778B2

(12) United States Patent
Danowski et al.

(10) Patent No.: US 9,650,778 B2
(45) Date of Patent: May 16, 2017

(54) URINAL WITH SPLASH GUARD

(71) Applicant: Zurn Industries, LLC, Milwaukee, WI (US)

(72) Inventors: Daniel James Danowski, Apex, NC (US); John Kevin Schoolcraft, Sanford, NC (US); Himanshu Bhatta, Raleigh, NC (US)

(73) Assignee: Zurn Industries, LLC, Milwaukee, WI (US)

( * ) Notice: Subject to any disclaimer, the term of this patent is extended or adjusted under 35 U.S.C. 154(b) by 158 days.

(21) Appl. No.: 14/469,684

(22) Filed: Aug. 27, 2014

(65) Prior Publication Data

US 2015/0101115 A1 Apr. 16, 2015

Related U.S. Application Data

(60) Provisional application No. 61/872,925, filed on Sep. 3, 2013.

(51) Int. Cl.
*E03D 3/00* (2006.01)
*E03D 13/00* (2006.01)

(52) U.S. Cl.
CPC ..... *E03D 13/00* (2013.01)

(58) Field of Classification Search
CPC ..... E03D 13/00
USPC ..... 4/300–442
See application file for complete search history.

(56) References Cited

U.S. PATENT DOCUMENTS

| | | | | | |
|---|---|---|---|---|---|
| 652,037 | A | | 6/1900 | Naumann | |
| 921,096 | A | | 5/1909 | Ebinger | |
| 946,851 | A | | 1/1910 | Bowman | |
| 955,485 | A | | 4/1910 | Walsh | |
| 974,145 | A | | 11/1910 | Hinsdale | |
| 1,070,643 | A | | 8/1913 | Weelans | |
| 1,114,670 | A | | 10/1914 | Baker | |
| 2,147,588 | A | | 2/1939 | Zinkil et al. | |
| D185,767 | S | | 7/1959 | McCann | |
| 2,980,919 | A | | 4/1961 | Otto et al. | |
| D195,080 | S | * | 4/1963 | Phillips, Jr. | E03D 13/00 D23/302 |
| 4,137,579 | A | * | 2/1979 | Soler | E03D 13/00 4/144.3 |
| D275,600 | S | * | 9/1984 | Stairs, Jr. | E03D 13/00 4/310 |
| 4,670,918 | A | | 6/1987 | Juaire et al. | |
| D294,966 | S | | 3/1988 | Kohler, Jr. et al. | |

(Continued)

*Primary Examiner* — Lori Baker
(74) *Attorney, Agent, or Firm* — Quarles & Brady LLP

(57) ABSTRACT

A urinal includes a urinal body having a top portion, a left sidewall, a right sidewall, and a rear wall, which define an internal cavity, and a bowl having a concave shape. The top portion includes a plenum chamber defined therein, which is configured to receive flush water and is in in fluid communication with the internal cavity of the urinal body via a plurality of baffle holes. A flow restrictor is disposed within the plenum chamber to slow a velocity of water flowing through the plenum chamber. The rear wall of the urinal body includes at least two angled portions extending laterally inward and rearward from the left and right sidewalls. The angled portions meet in a rounded corner. The at least two angled portions and the rounded corner are configured to deflect urine striking the rear wall such that the urine remains within the internal cavity.

15 Claims, 13 Drawing Sheets

(56) References Cited

U.S. PATENT DOCUMENTS 5,027,448 A * 7/1991 Wilkins ..... E03D 13/00 4/310
5,255,397 A 10/1993 Poole
5,287,563 A 2/1994 Peters
5,373,589 A 12/1994 Rego et al.
D360,255 S 7/1995 Nagato
D377,206 S * 1/1997 Tani ..... E03D 13/00 D23/302
5,732,416 A 3/1998 Albert
5,806,107 A 9/1998 Tilton et al.
5,983,410 A 11/1999 Webster
D420,730 S * 2/2000 Thomas ..... E03D 13/00 D23/302
6,055,681 A * 5/2000 Lyons ..... E03D 9/00 4/300.3
6,357,055 B1 3/2002 Gambla et al.
6,385,785 B1 5/2002 Linden
6,470,504 B1 10/2002 Neuo
6,920,648 B1 * 7/2005 Suski ..... E03D 13/00 4/222.1
7,017,198 B2 3/2006 Conn et al.
7,043,773 B2 5/2006 McAleenan, Jr.
7,398,565 B1 7/2008 Chou
7,412,732 B1 8/2008 Leonard
7,461,413 B2 * 12/2008 Lewis ..... E03D 13/00 4/300.3
7,921,478 B1 4/2011 Vanini
7,992,231 B1 8/2011 Schlicksup
8,215,040 B2 * 7/2012 Pascarelli ..... G09F 1/08 4/301
8,266,731 B2 9/2012 Marra
8,387,171 B2 * 3/2013 Farber ..... E03D 13/00 239/589.1
2002/0020006 A1 2/2002 Mason, Jr. et al.
2007/0151011 A1 7/2007 Brown
2008/0184471 A1 * 8/2008 Hampel ..... A47K 11/02 4/479
2010/0095445 A1 4/2010 Rice et al.
2010/0257665 A1 * 10/2010 Wilson ..... E03D 13/00 4/311
2011/0252552 A1 * 10/2011 Janssen ..... E03C 1/281 4/311
2014/0090159 A1 * 4/2014 Liebel ..... E03D 13/007 4/311
2016/0060856 A1 * 3/2016 McIntyre ..... E03D 11/12 4/311

* cited by examiner

URINAL WITH SPLASH GUARD

CROSS REFERENCE TO RELATED APPLICATION

The present application claims priority from U.S. Provisional Patent Application No. 61/872,925 filed on Sep. 3, 2013, which is incorporated herein by reference in its entirety.

BACKGROUND OF THE INVENTION

Field of the Invention

The present invention relates to a urinal and, more particularly, to a urinal configured to accommodate a range of flush volumes and prevent splashing of water and urine from the urinal.

Description of Related Art

In order to reduce water demand, conserve water supplies, and realize savings on costs related to water usage, businesses and building owners are increasingly upgrading restroom fixtures, including urinals and associated flush valves, that utilize less water per flush cycle. Typically, different urinal bodies are stocked and installed for accommodating different flush volumes. For instance, one model of urinal body may be designed to accommodate a flush volume of 0.125-0.25 gallon per flush while another model of urinal body may be designed to accommodate a flush volume of 0.5-1.0 gallon per flush. Accordingly, multiple models of urinals must be manufactured and kept in inventory to accommodate demand for different flush volumes. There has recently been movement in the market towards "universal" urinals that are rated flush volumes from 0.125-1.0 gallon per flush.

Further, urinals configured to accommodate smaller flush volumes typically have a flat rear wall at the back of the urinal. When a user of the urinal urinates against the rear wall of the urinal, there is a propensity for a significant amount of "splatter" or drops of urine to splash back from the interior of the urinal on to the floor near the urinal or on to the user.

SUMMARY OF THE INVENTION

Accordingly, there is a general need in the art for a "universal" urinal that is configured to accommodate a range of flush volumes in order to consolidate urinal models and for a urinal that prevents "splatter" of urine from the interior of the urinal.

According to one embodiment of the invention, consolidation of separate urinal models rated for accommodating different flush volumes allows for overall improvement in the appearance of the urinals and for uniformity of appearance, offers improved functionality, and allows inventory to be more flexible, because there is no longer any need to carry separate urinals for handling separate ranges of flush volumes.

According to another embodiment of the invention, a urinal includes an asymmetrical V-shaped rear wall opposing the user to prevent splatter of the urine stream back towards the user.

According to a particular embodiment of the present invention, a urinal is provided. The urinal includes a urinal body having a left sidewall, a right sidewall, and a rear wall extending from the left sidewall to the right sidewall; and a bowl disposed at a bottom of the urinal body, the bowl having a concave shape defining a bowl cavity. The left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity. The rear wall of the urinal body includes at least two angled portions extending laterally inward and rearward from the left and right sidewalls, and the angled portions meet in a rounded corner of the rear wall. The at least two angled portions and the rounded corner are configured to deflect urine striking the rear wall such that the urine remains within the internal cavity of the urinal body and falls into the bowl cavity.

According to another particular embodiment of the present invention, a urinal is provided. The urinal includes a urinal body having a top portion, a left sidewall, a right sidewall, and a rear wall extending from the left sidewall to the right sidewall; and a bowl disposed at a bottom of the urinal body, the bowl having a concave shape defining a bowl cavity. The left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity. The top portion of the urinal body includes a plenum chamber defined by a front wall of the top portion, a top wall of the urinal body, a back wall of the urinal body, a lower wall of the top portion positioned above the rear wall, and the left and right sidewalls of the urinal body, the plenum chamber being configured to receive flush water via a top opening in the top wall of the urinal body and being in fluid communication with the internal cavity of the urinal body via a plurality of baffle holes formed in the lower wall of the top portion. A flow restrictor is disposed within the plenum chamber to slow a velocity of water flowing through the plenum chamber to prevent splashing of water within the internal cavity of the urinal body and the bowl cavity.

According to yet another particular embodiment of the present invention, a urinal is provided. The urinal includes a urinal body having a top portion, a left sidewall, a right sidewall, and a rear wall extending from the left sidewall to the right sidewall; and a bowl disposed at a bottom of the urinal body, the bowl having a concave shape defining a bowl cavity. The left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity. The top portion of the urinal body includes a plenum chamber defined by a front wall of the top portion, a top wall of the urinal body, a back wall of the urinal body, a lower wall of the top portion positioned above the rear wall, and the left and right sidewalls of the urinal body, the plenum chamber being configured to receive flush water via a top opening in the top wall of the urinal body and being in fluid communication with the internal cavity of the urinal body via a plurality of baffle holes formed in the lower wall of the top portion. A flow restrictor is disposed within the plenum chamber to slow a velocity of water flowing through the plenum chamber to prevent splashing of water within the internal cavity of the urinal body and the bowl cavity. The rear wall of the urinal body includes at least two angled portions extending laterally inward and rearward from the left and right sidewalls, and the angled portions meet in a rounded corner of the rear wall. The at least two angled portions and the rounded corner are configured to deflect urine striking the rear wall such that the urine remains within the internal cavity of the urinal body and falls into the bowl cavity. The plurality of baffle holes in the lower wall of the top portion are aligned in a configuration corresponding to a shape of the interior surface of the rear wall of the urinal body such that water from the plenum chamber is distributed evenly across the interior surface of the rear wall.

Further details and advantages of the invention will become clear upon reading the following detailed description in conjunction with the accompanying drawing figures, wherein like parts are designated with like reference numerals throughout.

DETAILED DESCRIPTION OF THE INVENTION

Figure 1:
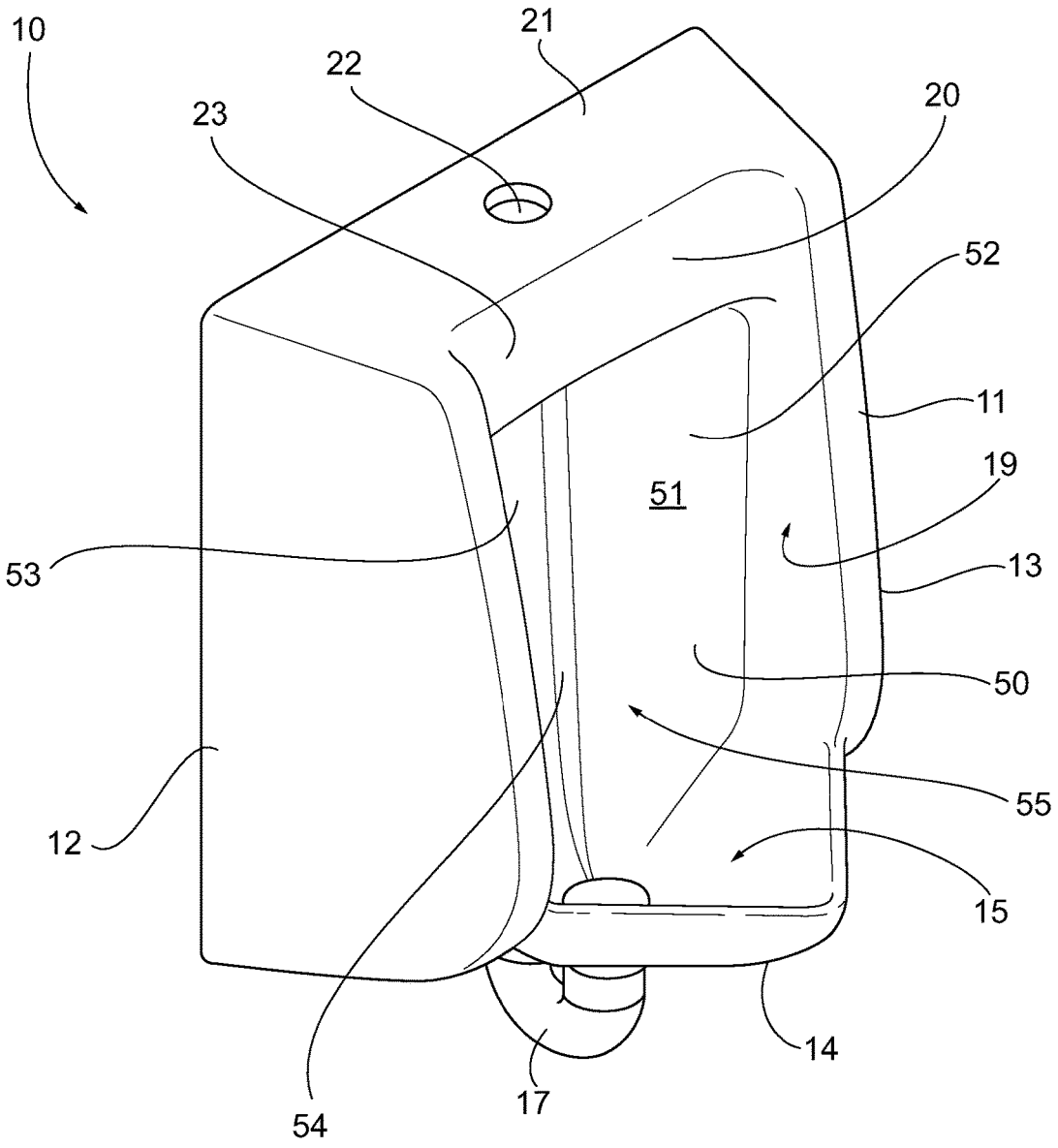
FIG. 1 depicts an upper left front perspective view of a urinal according to an embodiment of the present invention.
Figure 2:
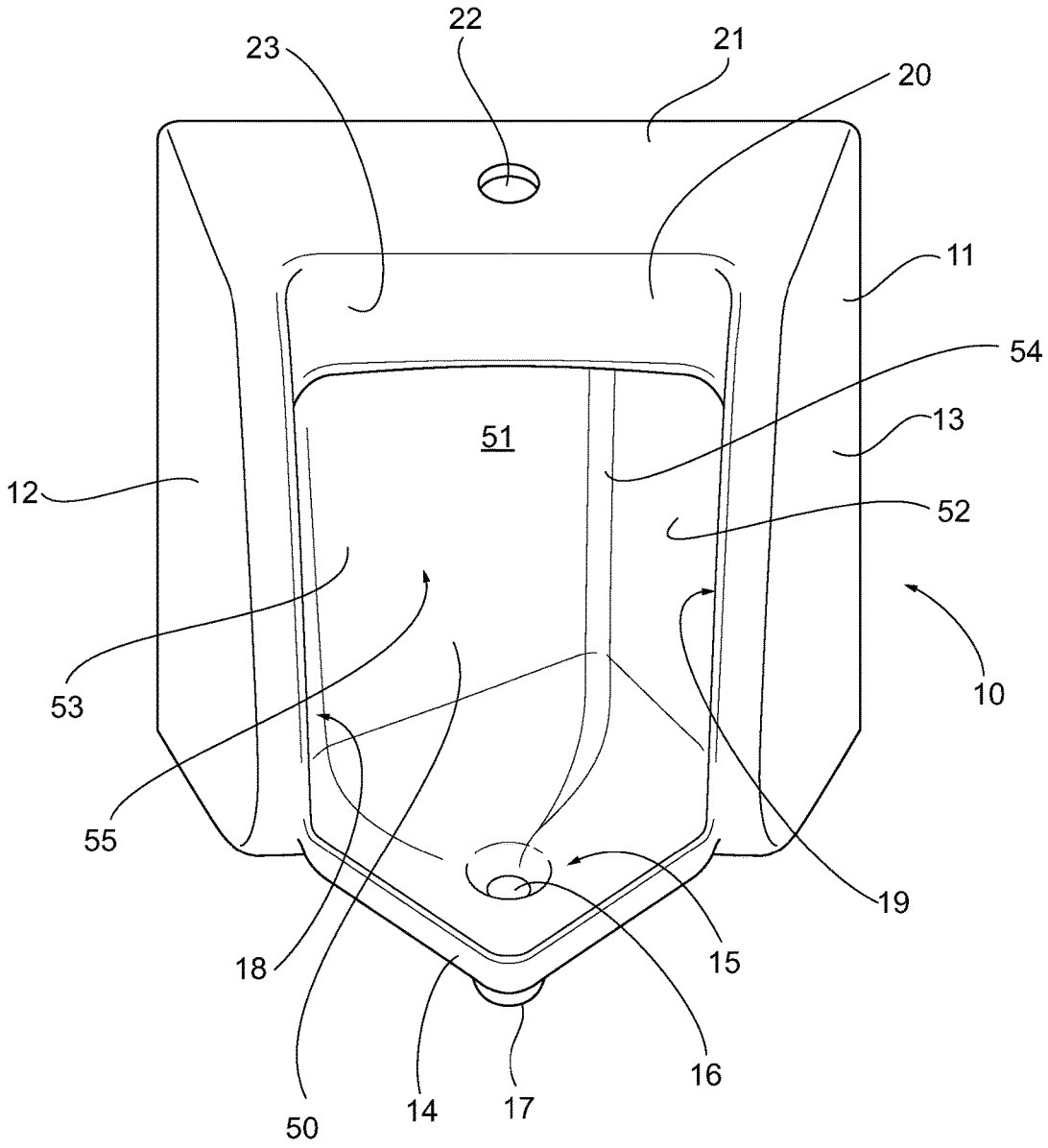
FIG. 2 depicts an upper front perspective view of the urinal of FIG. 1.

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

With reference to FIGS. 1-10, a urinal 10 is shown in accordance with an embodiment of the present invention. The urinal 10 includes a body 11 that is configured to accommodate flush volumes between approximately 0.125 gallon per flush and 1.0-1.5 gallons per flush depending on the customer's needs. That is to say, the urinal 10 is a "universal" urinal that is configured such that multiple models of urinals configured to accommodate different ranges of flush volumes may be consolidated into a single model configuration. As shown, the body 11 of the urinal 10 includes a left lateral sidewall 12, a right lateral sidewall 13, a bowl 14 positioned between the left sidewall 12 and the right sidewall 13 at the bottom of the urinal body 11, a top portion 20 extending from the left sidewall 12 to the right sidewall 13 at the top of the urinal body 11, a rear wall 50 extending between the left sidewall 12 and the right sidewall 13 between the top portion 20 and the bowl 14 of the urinal body 11, and a back wall 57 that partially defines the rear of the urinal 10. The left sidewall 12 defines an interior surface 18, the right sidewall 13 defines an interior surface 19, and the rear wall 50 defines an interior surface 51. The interior surfaces 18, 19, 51, collectively, define an internal cavity 55 of the urinal body 11, which is open toward the front of the urinal body 11 such that the internal cavity 55 is in fluid communication with the exterior of the urinal 10 at the front for receiving urine from a user of the urinal 10. The urinal body 11 also includes a back mounting plate or portion 56 provided at the bottom of the urinal body 11 below the back wall 57 for mounting the urinal 10 on to a wall surface in a manner known to be suitable to those having ordinary skill in the art.

As shown in FIGS. 1-4, 7, and 10, the bowl 14 has a substantially V-shape extending forwardly from the right and left sidewalls 12, 13 and defines a bowl cavity 15 that is open at the top to be in fluid communication with the internal cavity 55 of the urinal body 11 and the exterior of the urinal 10. The bowl 14 and bowl cavity 15 are shaped to correspond to the shape of the interior surfaces 18, 19, 51 of the left and right sidewalls 12, 13 and the rear wall 50, which will be discussed in further detail below. The bowl 14 includes a drain opening 16 at its bottom. The drain opening 16 places the bowl cavity 15 in communication with a trap 17 leading from the urinal 10 to the building waste line. The trap 17 is of standard configuration and may be of any type known to be suitable to those having ordinary skill in the art.

As shown in FIGS. 1-5, 9, and 10, the rear wall 50 of the urinal body 11 has an asymmetrical V-shape that defines a right angled portion 52 and a left angled portion 53 that extend laterally inward and rearward from the sidewalls 12, 13 to meet at a rounded corner 54 that is offset from the center of the urinal body 11 such that the left angled portion 53 is larger than the right angled portion 52. In this manner, the angled portions 52, 53 extend away from the front of the urinal body 11 and, thus, the user of the urinal 10, so that when urine strikes the interior surface 51, the urine is deflected by the angled portions 52, 53 such that the urine remains within the internal cavity 55 of the urinal body 11 rather than being deflected or splattered towards the front of the urinal 10 and the user. According to one embodiment of the present invention, the angled portions 52, 53 of the rear wall 50 meet at an angle greater than 90° with respect to each other, in particular at an angle between 90° and 120° with respect to each other, and even more particularly at an angle between 90° and 105°. According to a specific embodiment of the present invention, the angled portions 52, 53 of the rear wall 50 meet at an angle of 95° with respect to each other.

With reference to FIGS. 1-9, the top portion 20 of the urinal body 11 includes a top wall 21 that defines the top of the urinal body 11, a front wall 23, and a lower wall 24. A plenum chamber 26 having an interior surface 27 is formed within the top portion 20 of the urinal body 11 and is defined by the top wall 21, the front wall 23 of the top portion 20, the lower wall 24 of the top portion 20, the left and right sidewalls 12, 13 of the urinal body 11, and the back wall 57 of the urinal body 11. The top wall 21 includes a top opening 22 that extends through the top wall 21 and is provided to place the plenum chamber 26 in fluid communication with a flush valve (not shown) connected to the top wall 21 of the top portion 20 of the urinal body 11. The lower wall 24 of the top portion 20 extends across the top of the rear wall 50 and defines the top of the internal cavity 55 of the urinal body 11. The lower wall 24 includes a plurality of evenly spaced baffle holes 25 that extend through the lower wall 24 and place the plenum chamber 26 in fluid communication with the internal cavity 55 of the urinal body 11.

Figure 3:
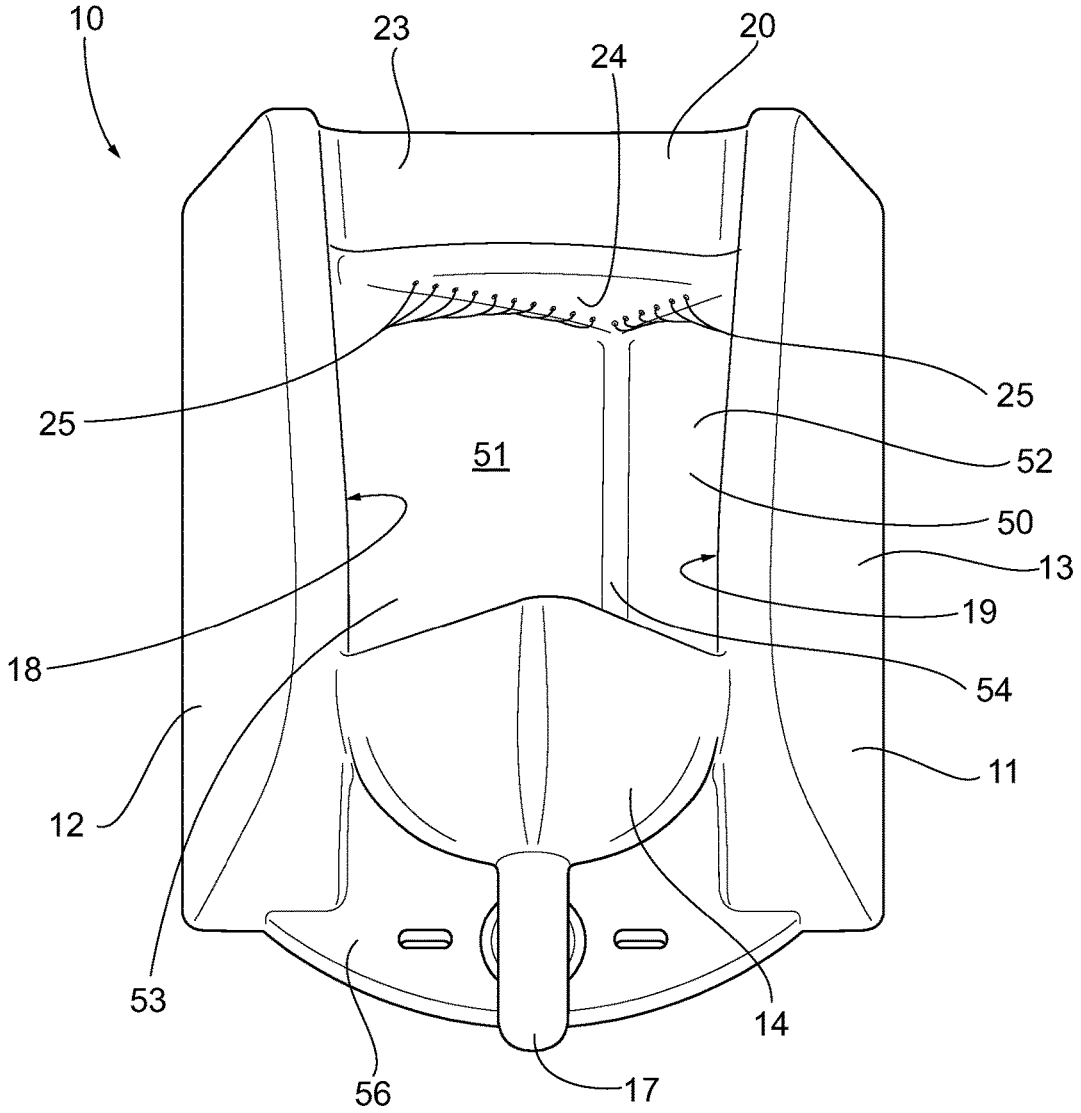
FIG. 3 depicts a lower front perspective view of the urinal of FIG. 1.
Figure 4:
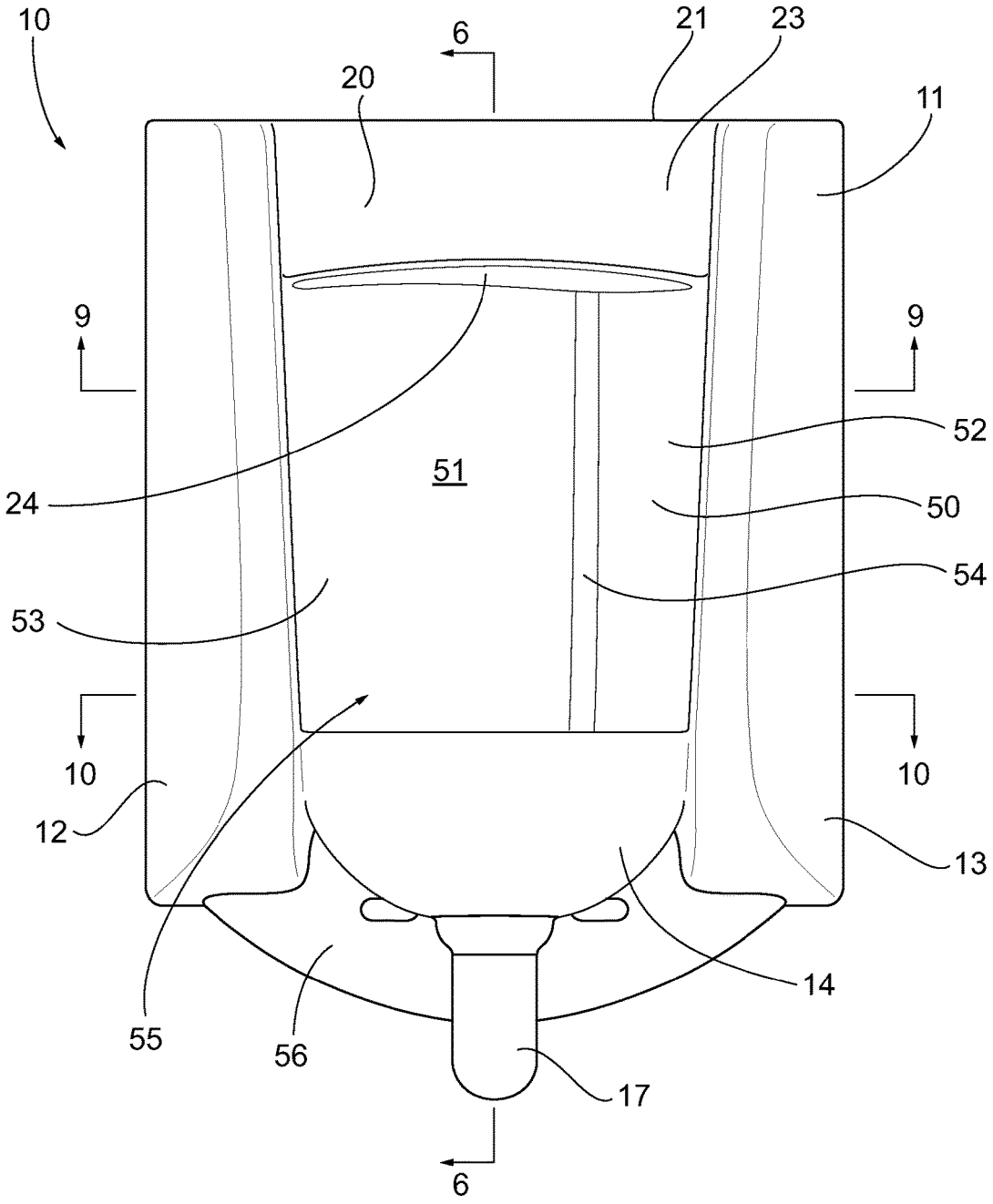
FIG. 4 depicts a front view of the urinal of FIG. 1.
Figure 5:
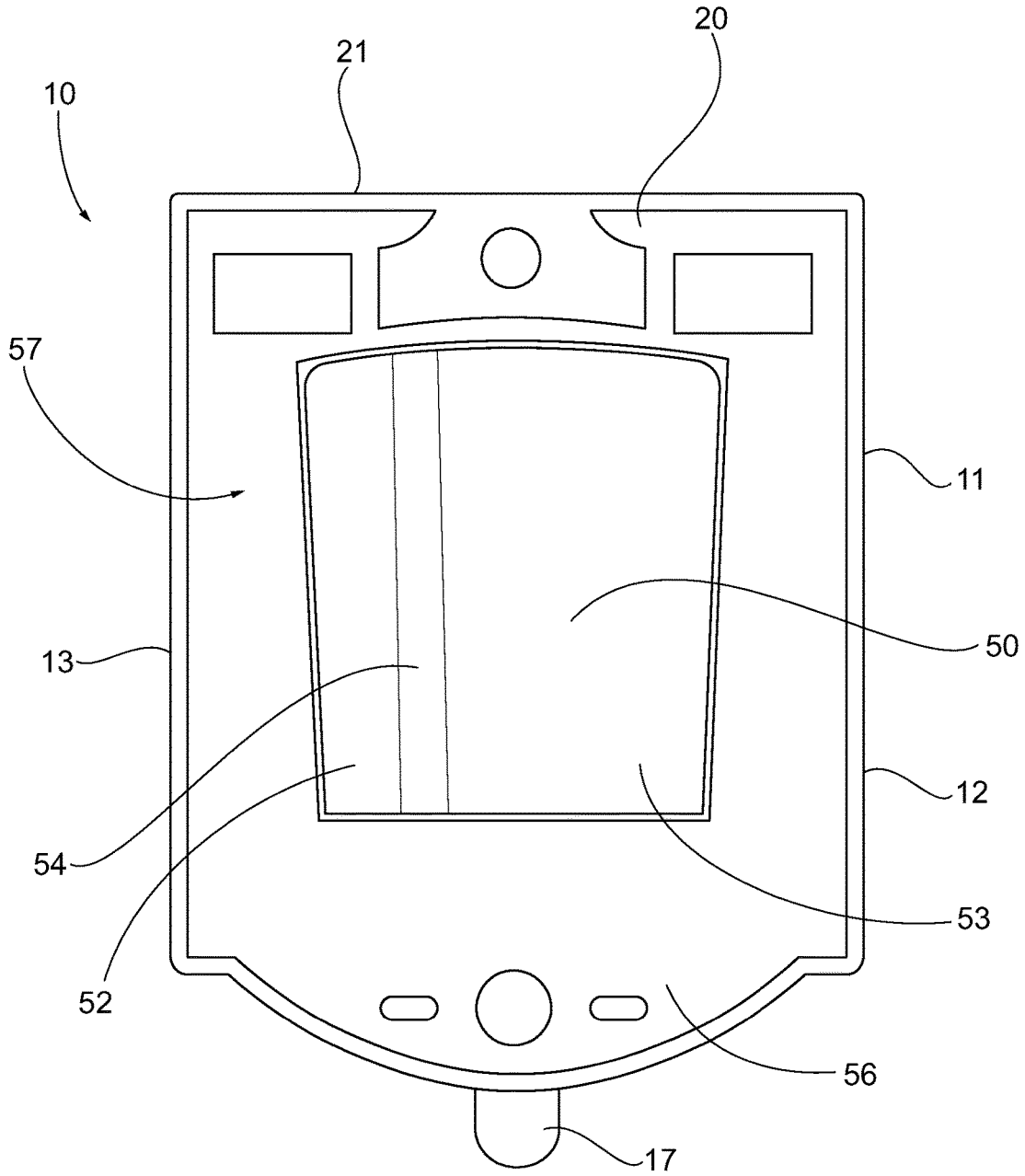
FIG. 5 depicts a rear view of the urinal of FIG. 1.
Figure 9:
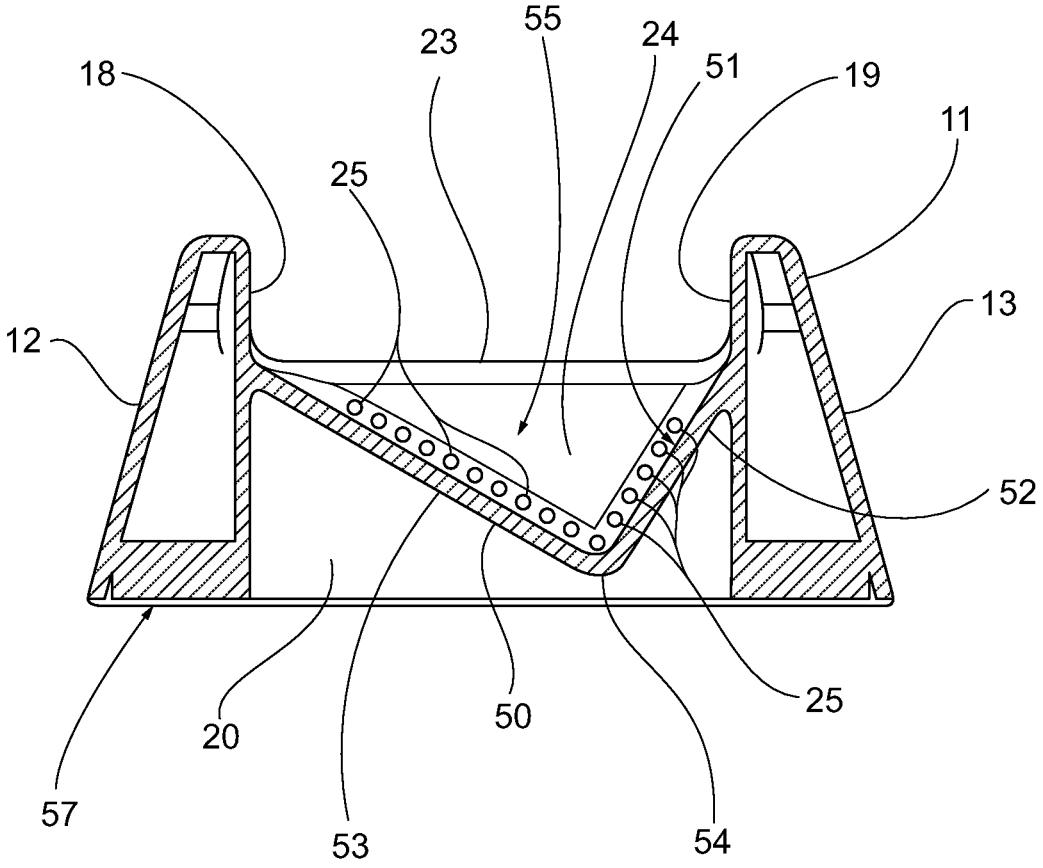
FIG. 9 depicts a cross-sectional view of the urinal of FIG. 1 taken along lines 9-9 shown in FIG. 4.
Figure 10:
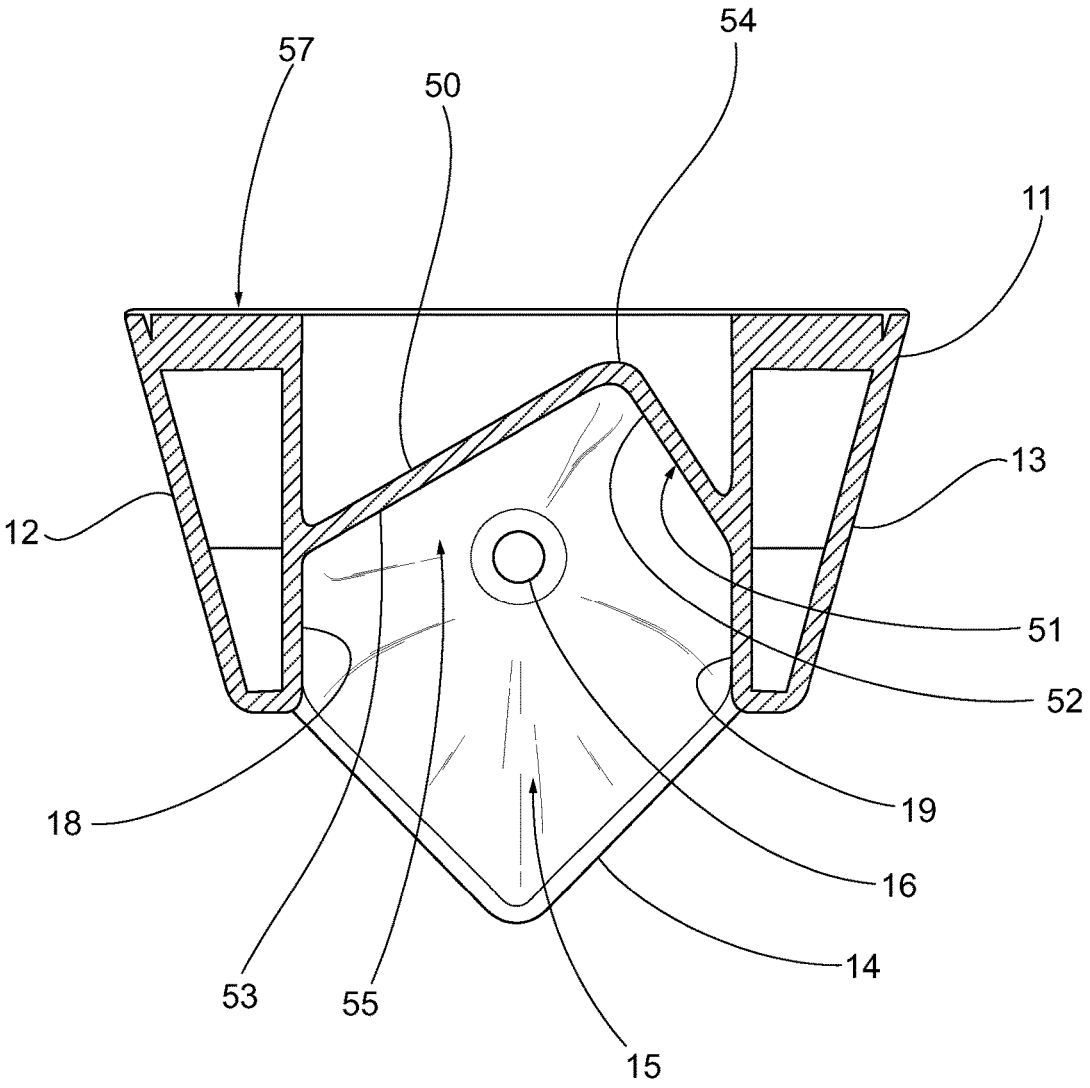
FIG. 10 depicts a cross-sectional view of the urinal of FIG. 1 taken along lines 10-10 shown in FIG. 4.

As shown in FIGS. 3 and 9, the baffle holes 25 are of uniform angle and diameter, and are all arrayed in the plane of the lower wall 24 of the top portion 20. The baffle holes 25 are arranged along angled lines corresponding to the shape of the angled portions 52, 53 and the contour of the interior surface 51 of the rear wall 50. Accordingly, water flowing downward from the plenum chamber 26 when the urinal 10 is flushed will be distributed evenly across the entire rear wall 50 by the array of baffle holes 25 and directed onto the interior surface 51 of the rear wall 50 so as to downwardly flow along the interior surface 51 toward the bowl 14. In this manner, the interior surface 51 of the rear wall 50 is effectively and efficiently cleaned every time the urinal 10 is flushed, even when the flush valve is configured to release only a small flush volume of water, such as 0.125 gallon, per activation.

Figure 6:
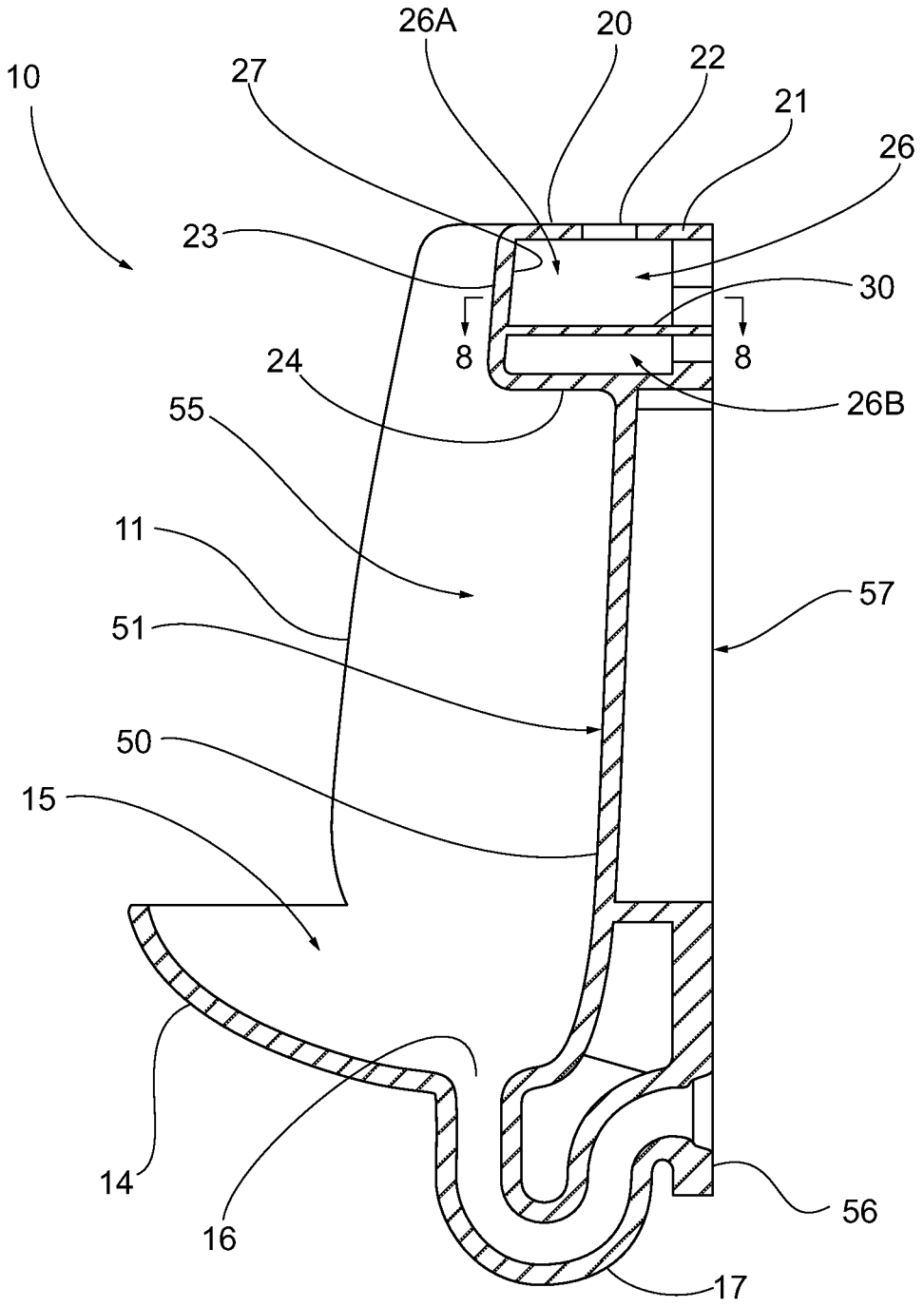
FIG. 6 depicts a cross-sectional view of the urinal of FIG. 1 taken along line 6-6 shown in FIG. 4.
Figure 7:
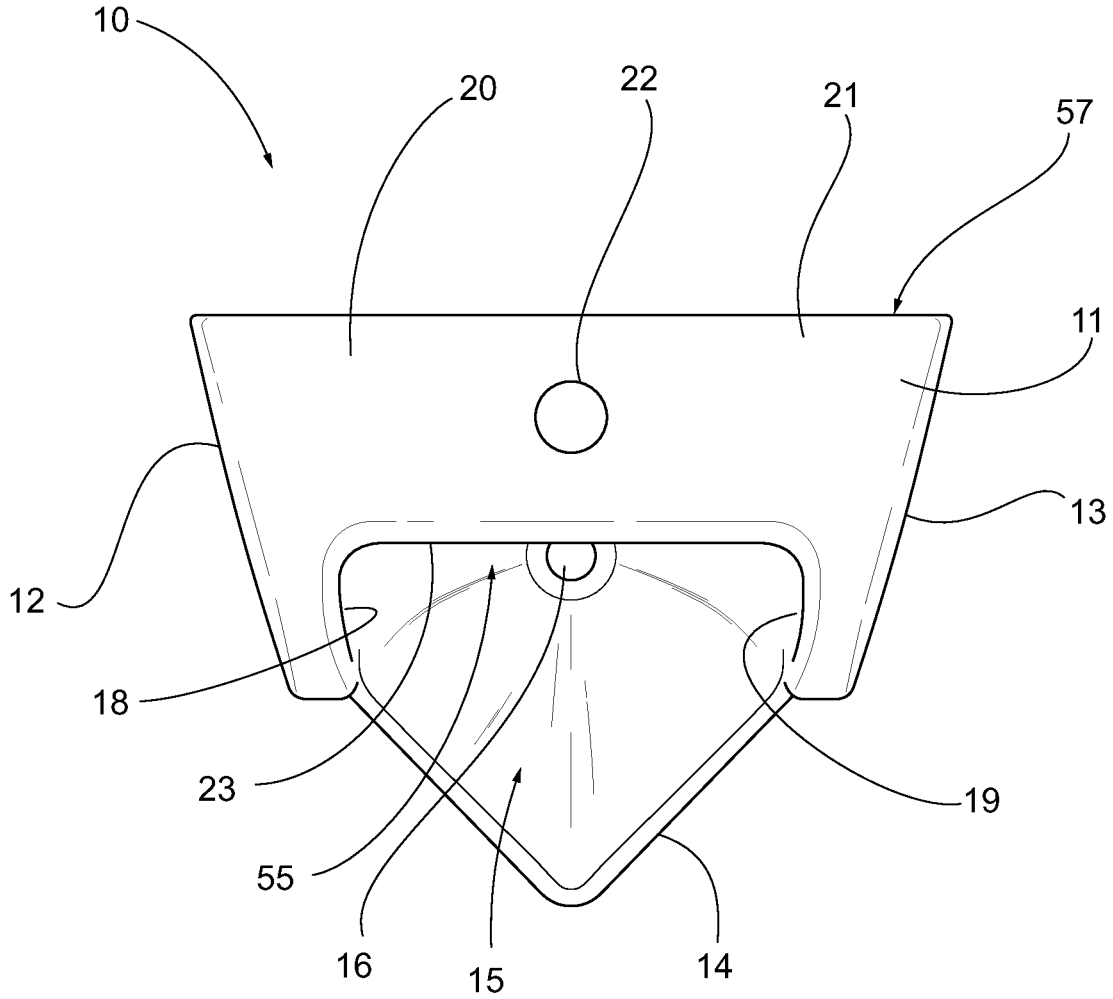
FIG. 7 depicts a top view of the urinal of FIG. 1.
Figure 8:
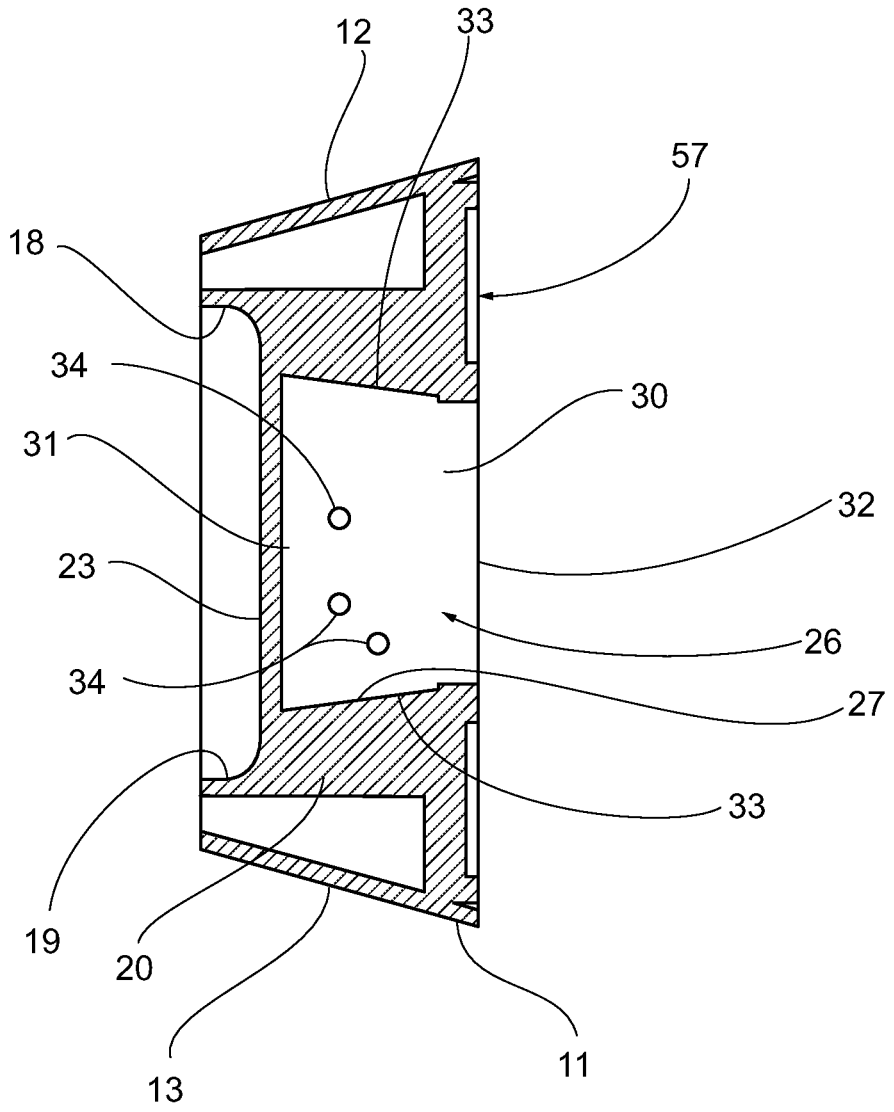
FIG. 8 depicts a cross-sectional view of the urinal of FIG. 1 taken along lines 8-8 shown in FIG. 6.

With reference to FIGS. 6 and 8, according to one embodiment of the present invention, the urinal 10 includes a flow restrictor in the form of a baffle plate 30 provided within the plenum chamber 26. The baffle plate 30 is attached to the interior surface 27 of the plenum chamber 26 and is positioned within the plenum chamber 26 so as to divide the plenum chamber 26 into an upper portion 26A extending between the top wall 21 and the baffle plate 30, and a lower portion 26B extending between the baffle plate 30 and the lower wall 24 of the top portion 20. As shown, the baffle plate 30 has a front side 31, a rear side 32, and two opposing lateral sides 33. The front side 31, the rear side 32, and the lateral sides 33 are attached to the interior surface 27 of the plenum chamber 26 to mount the baffle plate 30 within the plenum chamber 26. The baffle plate 30 further includes at least one hole 34 extending therethrough such that water from the flush valve via the top valve opening 22 flows through the upper portion 26A of the plenum chamber 26 to the baffle plate 30 and the at least one central hole 34 of the baffle plate 30 to the lower portion 26B of the plenum chamber 26 and the baffle holes 25 in the lower wall 24. More particularly, as shown in FIG. 8, the baffle plate 30 includes three holes 34 extending therethrough. Two of the holes 34 are shown to be aligned in the lateral direction, with the third being slightly offset, however, it is to be appreciated that the holes 34 may be numbered and arranged in any manner known to be suitable to one having ordinary skill in the art. In this manner, the baffle plate 30 acts as a flow restrictor within the plenum chamber 26 and serves to slow the velocity of water flowing from the flush valve through the plenum chamber 26 without creating excessive back pressure within the plenum chamber 26. By slowing the velocity of water flowing through the plenum chamber 26, the baffle plate 30 serves to prevent the splashing and spraying of flush water from the urinal 10 at higher flush volumes, such as 1.0-1.5 gallons per flush. The baffle plate 30 also serves to more evenly spread the water across the array of baffle holes 25 in the lower wall 24 such that water is evenly applied to the interior surface 51 of the rear wall 50 and the rear wall 50 is effectively cleansed during the flush cycle.

Figure 11:
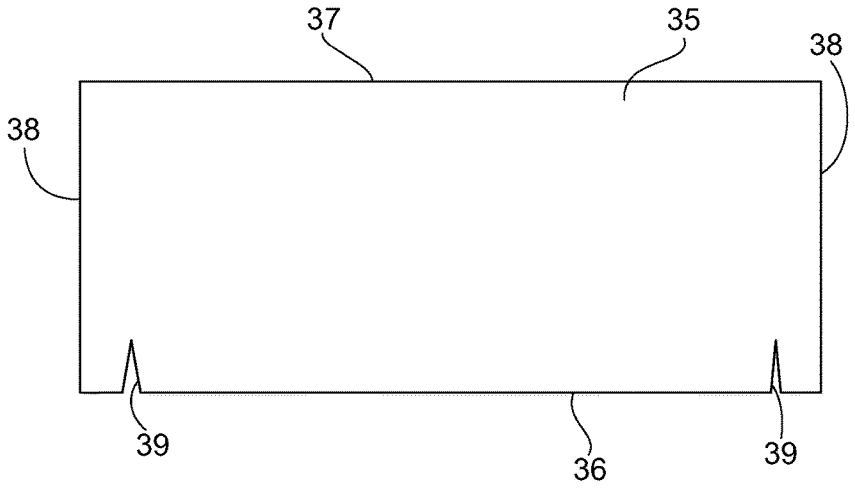
FIG. 11 depicts a top view of a baffle plate according to an embodiment of the present invention.
Figure 12:
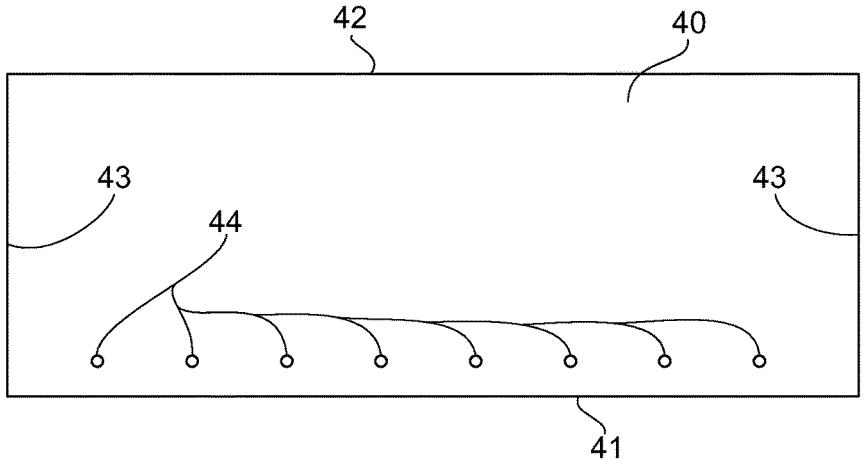
FIG. 12 depicts a top view of a baffle plate according to another embodiment of the present invention.
Figure 13:
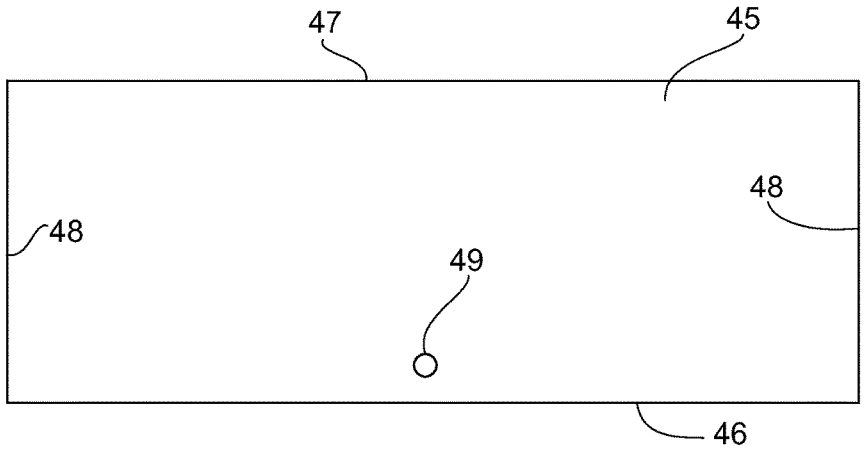
FIG. 13 depicts a top view of a baffle plate according to yet another embodiment of the present invention.

With reference to FIGS. 11-13, according to an alternative embodiment of the present invention, a baffle plate 35, 40, 45 is provided in the plenum chamber 26 to act as a flow restrictor rather than the baffle plate 30, discussed above. The baffle plate 35, 40, 45 is also mounted within the plenum chamber 26 so as to divide the plenum chamber 26 into the upper and lower portions 26A, 26B. The baffle plate 35, 40, 45 may also be mounted within the plenum chamber 26 with a gap of approximately ½ inch provided between a front side 36, 41, 46 and/or rear side 37, 42, 47 of the baffle plate 35, 40, 45 and the interior surface 27 of the plenum chamber 26 so that water is able to flow over the front side 36, 41, 46 and/or the rear side 37, 42, 47 of the baffle plate 35, 40, 45 into the lower portion 26B of the plenum chamber 26. Accordingly, the baffle plate 35, 40, 45 also serves to slow the velocity of water flowing through the plenum chamber 26 in order to prevent splashing of water from the urinal body 11 during a flush cycle.

The baffle plate 35, 40, 45 also incorporates an opening feature at or near the front side 36, 41, 46 that diverts water to the sides of the plenum chamber 26 to spread the water evenly over the array of baffle holes 25 in the lower wall 24 and, thus, the interior surface 51 of the rear wall 50, as discussed above. In particular, as shown in FIG. 11, the baffle plate 35 according to one alternative embodiment of the invention includes a front side 36, a rear side 37, and opposing lateral sides 38. Two V-shaped openings/notches 39 are formed extending inwardly from the front side 36 of the baffle plate 35 in order to allow more water to flow towards the lateral sides 38 of the baffle plate 35 so that water is diverted and spread evenly across the entire array of baffle holes 25 in the lower wall 24. As shown in FIG. 12, the baffle plate 40 according to another alternative embodiment of the present invention includes a front side 41, a rear side 42, and opposing lateral sides 43. A plurality of spaced baffle holes 44 extending through the baffle plate 40 are arranged in a line near the front side 41 of the baffle plate 40 so that water is diverted and spread evenly across the entire array of baffle holes 25 in the lower wall 24. As shown in FIG. 13, the baffle plate 45 according to yet another alternative embodiment of the present invention includes a front side 46, a rear side 47, and opposing lateral sides 48. A single hole 49 extending through the baffle plate 45 is arranged in a central position near the front side 46 of the baffle plate 45 so that water is diverted and spread evenly across the entire array of baffle holes 25 in the lower wall 24.

Figure 14:
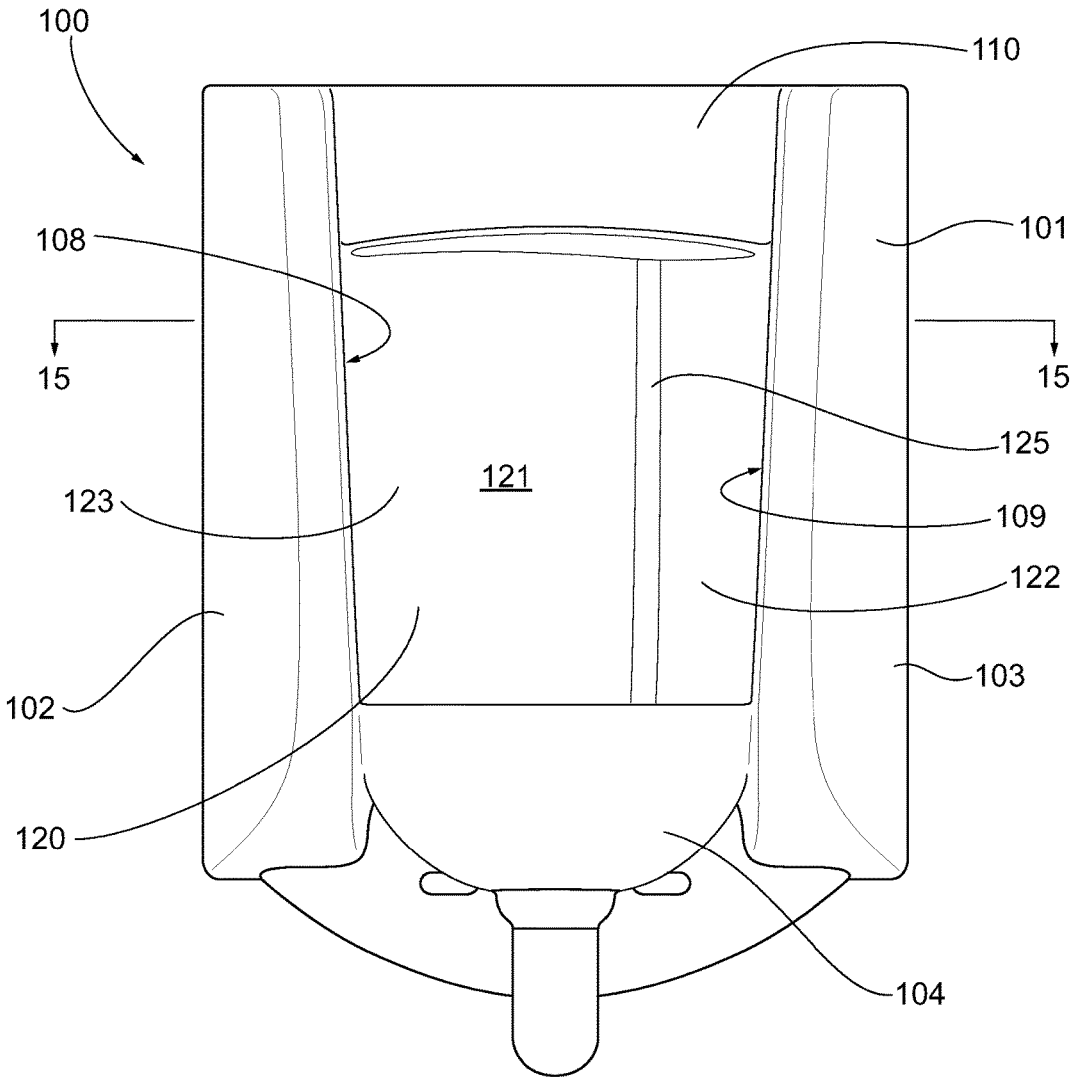
FIG. 14 depicts a front view of a urinal according to another embodiment of the present invention.
Figure 15:
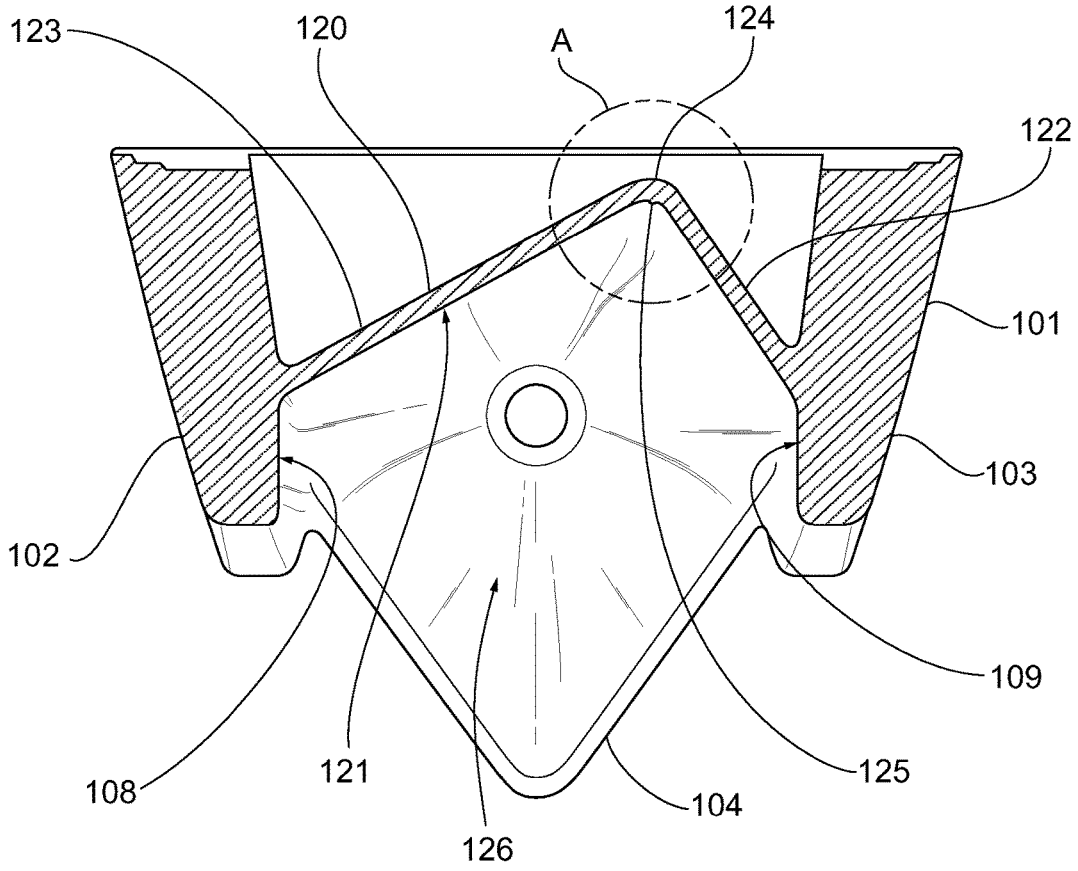
FIG. 15 depicts a cross-sectional view of the urinal of FIG. 14 taken along lines 15-15 shown in FIG. 14.
Figure 16:
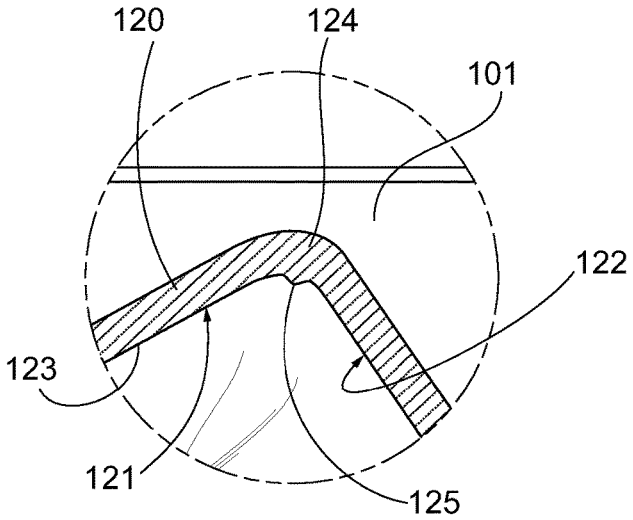
FIG. 16 depicts a detailed view of the area "A" shown in the cross-sectional view of FIG. 15.

With reference to FIGS. 14-16, a urinal 100 is shown in accordance with another embodiment of the present invention. The urinal 100 is similar in construction to the urinal 10 discussed above with respect to FIGS. 1-10 and, as such, certain common features between the urinal 100 and the urinal 10 will not be discussed in detail below. The urinal 100 includes a body 101 that is configured to accommodate flush volumes between approximately 0.125 gallon per flush and 1.0-1.5 gallons per flush depending on the customer's needs. That is to say, the urinal 100 is a "universal" urinal that is configured such that multiple models of urinals configured to accommodate different ranges of flush volumes may be consolidated into a single model configuration. As shown in FIGS. 14-16, the body 101 of the urinal 100 includes a left lateral sidewall 102, a right lateral sidewall 103, a bowl 104 positioned between the left sidewall 102 and the right sidewall 103 at the bottom of the urinal body 101, a top portion 110 extending from the left sidewall 102 to the right sidewall 103 at the top of the urinal body 101, and a rear wall 120 extending between the left sidewall 102 and the right sidewall 103 between the top portion 110 and the bowl 104 of the urinal body 101. The left sidewall 102 defines an interior surface 108, the right sidewall 103 defines an interior surface 109, and the rear wall 120 defines an interior surface 121. The interior surfaces 108, 109, 121, collectively, define an internal cavity 126 of the urinal body 101, which is open toward the front of the urinal body 101 such that the internal cavity 126 is in fluid communication with the exterior of the urinal 100 at the front for receiving urine from a user of the urinal 100.

As shown in FIGS. 14-16, the rear wall 120 of the urinal body 101 has an asymmetrical V-shape that defines a right angled portion 122 and a left angled portion 123 that extend laterally inward and rearward from the sidewalls 102, 103 to meet at a rounded corner 124 that is offset from the center of the urinal body 101 such that the left angled portion 123 is larger than the right angled portion 122. In this manner, the angled portions 122, 123 extend away from the front of the urinal body 101 and, thus, the user of the urinal 100, so that when urine strikes the interior surface 121, the urine is deflected by the angled portions 122, 123 such that the urine remains within the internal cavity 126 of the urinal body 101 rather than being deflected or splattered towards the front of the urinal 100 and the user. According to this embodiment, the angled portions 122, 123 of the rear wall 120 meet at an angle greater than 90° with respect to each other, in particular at an angle between 90° and 120° with respect to each other, and even more particularly at an angle between 90° and 105°. According to a specific embodiment of the present invention, the angled portions 122, 123 of the rear wall 120 meet at an angle of 95° with respect to each other. An anti-splash protrusion 125, which may be in the form of a rib having a rounded or tapering cross section, is positioned on the inside surface 121 of the rear wall 120 at or near the apex of the rounded corner 124. The anti-splash protrusion 125 extends vertically along the rounded corner 124 from near the top of the rear wall 120 into the bowl 104, which includes a corner shaped to correspond to the rounded corner 124 of the rear wall 120. The anti-splash protrusion 125 is provided to deflect urine directed into the rounded corner 124 towards the angled portions 122, 123 of the rear wall 120 rather than back towards the user so that the urine remains within the internal cavity 126 of the urinal body 101.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. A urinal, comprising:

a urinal body having a left sidewall, a right sidewall, and a rear wall extending from the left sidewall to the right sidewall; and a bowl disposed at a bottom of the urinal body, the bowl having a concave shape defining a bowl cavity, wherein the left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity, wherein the rear wall of the urinal body includes at least two angled portions extending laterally inward and rearward from the left and right sidewalls, and the angled portions meet in a rounded corner of the rear wall, wherein the at least two angled portions and the rounded corner are configured to deflect urine striking the rear wall such that the urine remains within the internal cavity of the urinal body and falls into the bowl cavity, wherein the urinal body further includes a top portion disposed above the internal cavity of the urinal body and the top portion includes a plenum chamber defined by a front wall of the top portion, a top wall of the urinal body, a back wall of the urinal body, a lower wall of the top portion positioned above the rear wall, and the left and right sidewalls of the urinal body, wherein the plenum chamber is configured to receive flush water via a top opening in the top wall of the urinal body and being in fluid communication with the internal cavity of the urinal body via a plurality of baffle holes formed in the lower wall of the top portion, and wherein a flow restrictor is disposed within the plenum chamber to slow a velocity of water flowing through the plenum chamber to prevent splashing of water within the internal cavity of the urinal body and the bowl cavity.

2. The urinal according to claim 1, wherein the flow restrictor comprises a baffle plate disposed within the plenum chamber that divides the plenum chamber into an upper portion and a lower portion, the baffle plate having at least one opening defined therein to allow water to flow from the upper portion of the plenum chamber to the lower portion of the plenum chamber.

3. The urinal according to claim 2, wherein the baffle plate is configured to spread water evenly across the plurality of baffle holes formed in the lower wall of the top portion.

4. The urinal according to claim 1, wherein the bowl has a substantially V-shape extending outwardly from the sidewalls.

5. The urinal according to claim 1, wherein the shape of the bowl corresponds to a shape of the interior surfaces of the rear wall and the left and right sidewalls of the urinal body.

6. The urinal according to claim 1, wherein the rounded corner of the rear wall is offset from a center of the urinal body.

7. A urinal, comprising:

a urinal body having a top portion, a left sidewall, a right sidewall, and a rear wall extending from the left sidewall to the right sidewall; and a bowl disposed at a bottom of the urinal body, the bowl having a concave shape defining a bowl cavity, wherein the left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity, wherein the top portion of the urinal body includes a plenum chamber defined by a front wall of the top portion, a top wall of the urinal body, a back wall of the urinal body, a lower wall of the top portion positioned above the rear wall, and the left and right sidewalls of the urinal body, the plenum chamber being configured to receive flush water via a top opening in the top wall of the urinal body and being in fluid communication with the internal cavity of the urinal body via a plurality of baffle holes formed in the lower wall of the top portion, and wherein a flow restrictor is disposed within the plenum chamber to slow a velocity of water flowing through the plenum chamber to prevent splashing of water within the internal cavity of the urinal body and the bowl cavity.

8. The urinal according to claim 7, wherein the rear wall of the urinal body includes at least two angled portions extending laterally inward and rearward from the left and right sidewalls, and the angled portions meet in a rounded corner of the rear wall.

9. The urinal according to claim 8, wherein the at least two angled portions and the rounded corner are configured to deflect urine striking the rear wall such that the urine remains within the internal cavity of the urinal body and falls into the bowl cavity.

10. The urinal according to claim 8, wherein the rounded corner of the rear wall is offset from a center of the urinal body.

11. The urinal according to claim 8, wherein the shape of the bowl corresponds to a shape of the interior surfaces of the rear wall and the left and right sidewalls of the urinal body.

12. The urinal according to claim 7, wherein the bowl has a substantially V-shape extending outwardly from the sidewalls.

13. The urinal according to claim 7, wherein the flow restrictor comprises a baffle plate disposed within the plenum chamber that divides the plenum chamber into an upper portion and a lower portion, the baffle plate having at least one opening defined therein to allow water to flow from the upper portion of the plenum chamber to the lower portion of the plenum chamber.

14. The urinal according to claim 13, wherein the baffle plate is configured to spread water evenly across the plurality of baffle holes formed in the lower wall of the top portion.

15. A urinal, comprising:

a urinal body having a top portion, a left sidewall, a right sidewall, and a rear wall extending from the left sidewall to the right sidewall; and a bowl disposed at a bottom of the urinal body, the bowl having a concave shape defining a bowl cavity, wherein the left sidewall has an interior surface, the right sidewall has an interior surface, the rear wall has an interior surface, and the interior surfaces of the left and right sidewalls and the rear wall, collectively, define an internal cavity of the urinal body, the internal cavity of the urinal body being in fluid communication with the bowl cavity, wherein the top portion of the urinal body includes a plenum chamber defined by a front wall of the top portion, a top wall of the urinal body, a back wall of the urinal body, a lower wall of the top portion positioned above the rear wall, and the left and right sidewalls of the urinal body, the plenum chamber being configured to receive flush water via a top opening in the top wall of the urinal body and being in fluid communication with the internal cavity of the urinal body via a plurality of baffle holes formed in the lower wall of the top portion, wherein a flow restrictor is disposed within the plenum chamber to slow a velocity of water flowing through the plenum chamber to prevent splashing of water within the internal cavity of the urinal body and the bowl cavity, wherein the rear wall of the urinal body includes at least two angled portions extending laterally inward and rearward from the left and right sidewalls, and the angled portions meet in a rounded corner of the rear wall, wherein the at least two angled portions and the rounded corner are configured to deflect urine striking the rear wall such that the urine remains within the internal cavity of the urinal body and falls into the bowl cavity, and wherein the plurality of baffle holes in the lower wall of the top portion are aligned in a configuration corresponding to a shape of the interior surface of the rear wall of the urinal body such that water from the plenum chamber is distributed evenly across the interior surface of the rear wall.

* * * * *